US007510252B2

(12) United States Patent
Conca et al.

(10) Patent No.: US 7,510,252 B2
(45) Date of Patent: Mar. 31, 2009

(54) METHOD OF HIDING INKJET PRINTHEAD DIE BOUNDARIES

(75) Inventors: Michael Vincent Conca, Vancouver, WA (US); William S. Osbome, Ct. Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 520 days.

(21) Appl. No.: 10/978,079

(22) Filed: Oct. 28, 2004

(65) Prior Publication Data

US 2006/0092198 A1 May 4, 2006

(51) Int. Cl.
*B41J 29/38* (2006.01)

(52) U.S. Cl. ..... 347/9; 347/12; 347/13

(58) Field of Classification Search ..... 347/9, 347/12, 13

See application file for complete search history.

(56) References Cited

U.S. PATENT DOCUMENTS

| | | | | |
|---|---|---|---|---|
| 5,625,389 | A * | 4/1997 | Eriksen et al. | 347/41 |
| 5,684,517 | A * | 11/1997 | Clemente et al. | 347/43 |
| 5,943,083 | A * | 8/1999 | Defieuw | 347/171 |
| 6,254,217 | B1 * | 7/2001 | Askeland et al. | 347/43 |
| 6,394,579 | B1 * | 5/2002 | Boyd et al. | 347/47 |
| 6,435,652 | B1 * | 8/2002 | Rezanka | 347/42 |
| 6,450,614 | B1 * | 9/2002 | Scheffelin et al. | 347/42 |
| 6,832,823 | B1 | 12/2004 | Askeland et al. | |
| 2002/0140769 | A1 * | 10/2002 | Kuwahara | 347/40 |
| 2003/0035043 | A1 * | 2/2003 | Sugiyama et al. | 347/171 |
| 2005/0046651 | A1 * | 3/2005 | Askren et al. | 347/12 |

* cited by examiner

*Primary Examiner*—Manish S Shah
*Assistant Examiner*—Laura E Martin

(57) ABSTRACT

Methods are disclosed for reducing visible print defects in printers having multi-die printheads oriented substantially perpendicular to the print media path. The exemplary methods include performing multiple print passes while alternately disabling the end nozzles on adjacent printhead die.

9 Claims, 6 Drawing Sheets

METHOD OF HIDING INKJET PRINTHEAD DIE BOUNDARIES

FIELD OF INVENTION

This invention relates generally to methods of minimizing print quality defects in printers having multiple-die printhead assemblies.

BACKGROUND

Inkjet printers are well known in the art. Small droplets of liquid ink, propelled by thermal heating, piezoelectric actuators, or some other mechanism, are deposited by a printhead on a print media, such as paper.

In scanning-carriage inkjet printing systems, inkjet printheads are typically mounted on a carriage that is moved back and forth across the print media. As the printheads are moved across the print media, a control system activates the printheads to deposit or eject ink droplets onto the print media to form text and images. The print media is generally held substantially stationary while the printheads complete a "print swath", typically an inch or less in height; the print media is then advanced between print swaths. The need to complete numerous carriage passes back and forth across a page has meant that inkjet printers have typically been significantly slower than some other forms of printers, such as laser printers, which can essentially produce a page-wide image.

The ink ejection mechanisms of inkjet printheads are typically manufactured in a manner similar to the manufacture of semiconductor integrated circuits. The print swath for a printhead is thus typically limited by the difficulty in producing very large semiconductor chips or "die". Consequently, to produce printheads with wider print swaths, other approaches are used, such as configuring multiple printhead dies in a printhead module, such as a "page wide array". Print swaths spanning an entire page width, or a substantial portion of a page width, can allow inkjet printers to compete with laser printers in print speed.

Using multiple printhead die in a printhead assembly can create other problems, however. While the physical spacings of the ink ejection mechanisms (or "nozzles") in a single die are determined by the semiconductor manufacturing steps, which are extremely precise, the spacing between nozzles in different die within a module are subject to slight misalignments. Further, the aerodynamic effects on ink droplets ejected by nozzles near the end of a printhead die may be different than the aerodynamic effects on ink droplets ejected nearer the center of the die. These and other factors can cause visible print defects on the printed media corresponding to the boundaries between die. These print defects generally take the form of light or dark lines or streaks on the page.

Inkjet printers often utilize multi-pass print modes to improve print quality. By applying only a portion of the total ink on each pass, less liquid is applied to page at each pass, minimizing color bleed due to mixing of inks at color boundaries and buckling or "cockle" of the print media. Multiple print passes also allow greater optical densities to be achieved in the final print. Multiple pass printing takes longer than single pass printing, but print quality can be substantially improved.

There is a need for methods that reduce visible print defects in images produced by multiple die printhead assemblies.

SUMMARY

Exemplary embodiments of the invention include methods of reducing visible print defects in printers having multi-die printheads oriented substantially perpendicular to the print media path. The exemplary methods include performing multiple print passes while alternately disabling the end nozzles on adjacent printhead die.

Other aspects and advantages of the present invention will become apparent from the following detailed description, taken in conjunction with the accompanying drawings, illustrating by way of example the principles of the invention.

DESCRIPTION OF EMBODIMENTS OF THE INVENTION

Embodiments of the invention are described with respect to an exemplary inkjet printing system; however, the invention is not limited to the exemplary system, nor to the field of inkjet printing, but may be utilized in other systems.

In the following specification, for purposes of explanation, specific details are set forth in order to provide an understanding of the present invention. It will be apparent to one skilled in the art, however, that the present invention may be practiced without these specific details. Reference in the specification to "one embodiment" or "an exemplary embodiment" means that a particular feature, structure, or characteristic described in connection with the embodiment is included in at least one embodiment. The appearance of the phrase "in one embodiment" in various places in the specification do not necessarily refer to the same embodiment.

Figure 1:
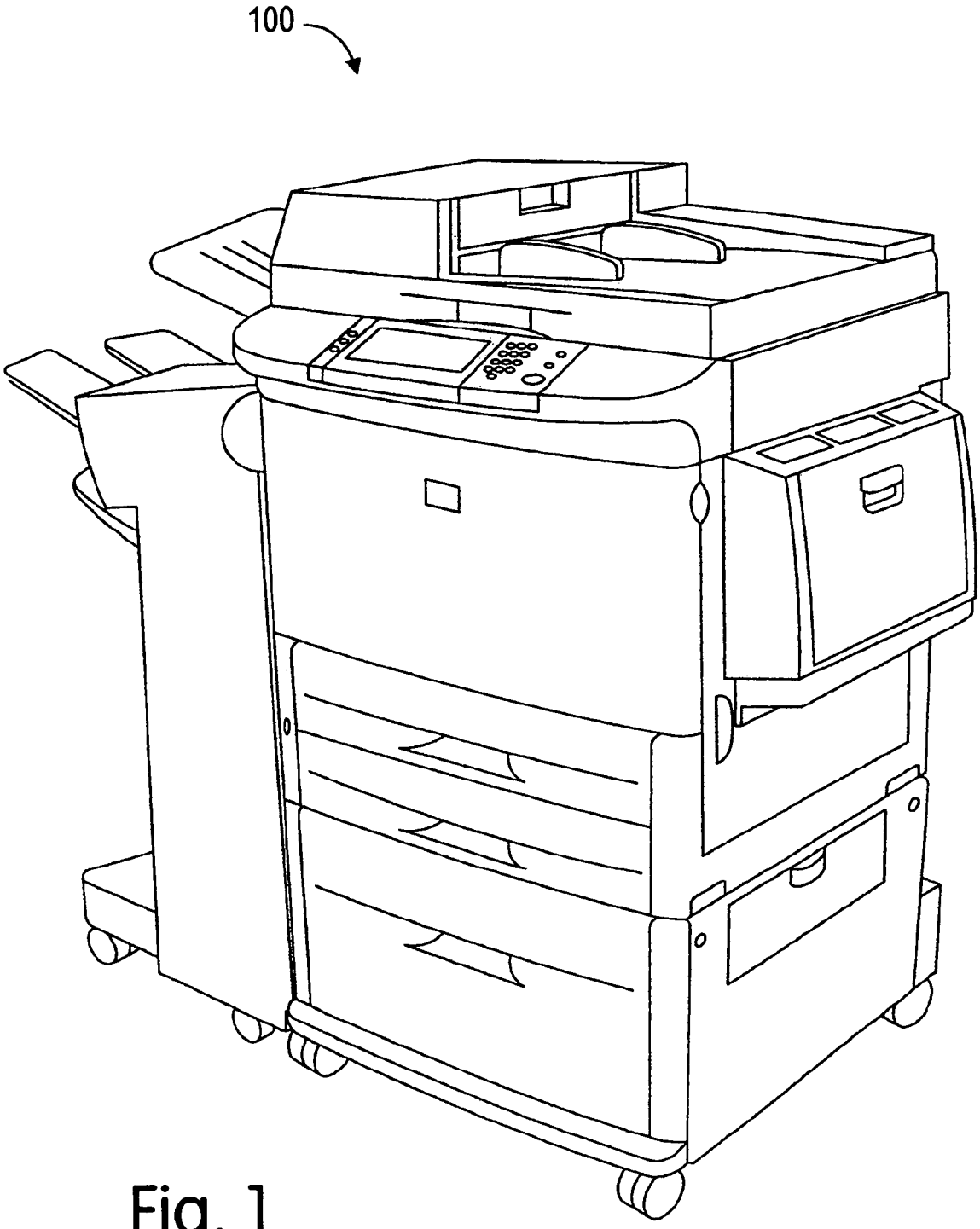
FIG. 1 illustrates an exemplary inkjet printing system in which embodiments of the invention may be utilized.

FIG. 1 illustrates an exemplary inkjet printing system 100 in which embodiments of the invention may be utilized. Intended for moderately high volume printing, the system may also include multiple other functions and may, for example, be connected to an office network to provide printing, scanning, and faxing capabilities to a workgroup.

Figure 2:
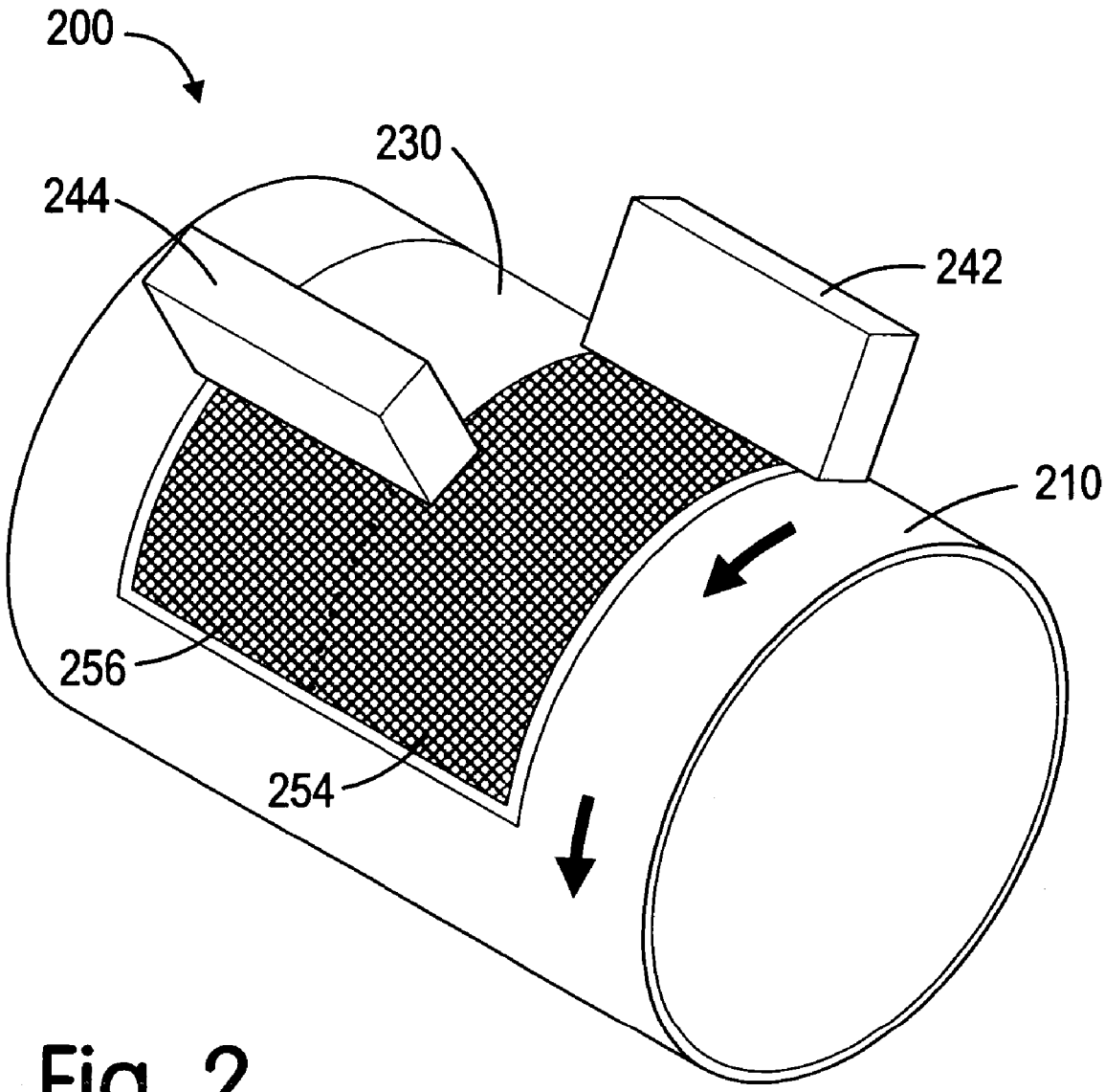
FIG. 2 illustrates the paper path and printhead mechanisms of an exemplary inkjet printing system in which embodiments of the invention may be utilized.

FIG. 2 illustrates the basic media path and printhead mechanisms 200 of an exemplary inkjet printing system in which embodiments of the invention may be utilized. As shown in FIG. 2, print media 230, such as a sheet of paper, is held to a rotating drum 210 by air suction. The print media 230 is rotated past print head assemblies 242, 244 that remain substantially stationary during the printing process. More than one printhead assembly may be utilized to span the page width as indicated; one printhead assembly 242 may print a first portion 254 of the page width, and an additional printhead assembly 244 may print a second portion 256 of the page width. Alternately, a single "page-wide" printhead may be employed, or more than two printhead assemblies may be used to span the printed page. Each printhead assembly comprises multiple printhead die arrayed along the length of the assembly, and each may print multiple primary colors, as well as black ink and a "fixer" fluid, as discussed below. Each illustrated printhead assembly 242, 244 may also comprise separate assemblies for each ink color, or multiple colors may be combined in a single assembly, as is known in the art.

In multi-pass printing, the print media 230 is held to the drum 210 by suction for more than one revolution of the drum, with the printhead assemblies 242, 244 depositing ink during each pass of the print media. The printer may include drying mechanisms (not shown) to accelerate the drying of the printed media, which may, for example, be placed near the bottom of the drum 210 such that the printed media may be at least partially dried between printing passes. The printhead assemblies 242, 244 may typically be mounted on carriages (not shown) which permit the printheads to moved side-to-side to different locations on the drum or off the drum entirely for servicing, or to reposition the printheads for different paper configurations.

Figure 3:
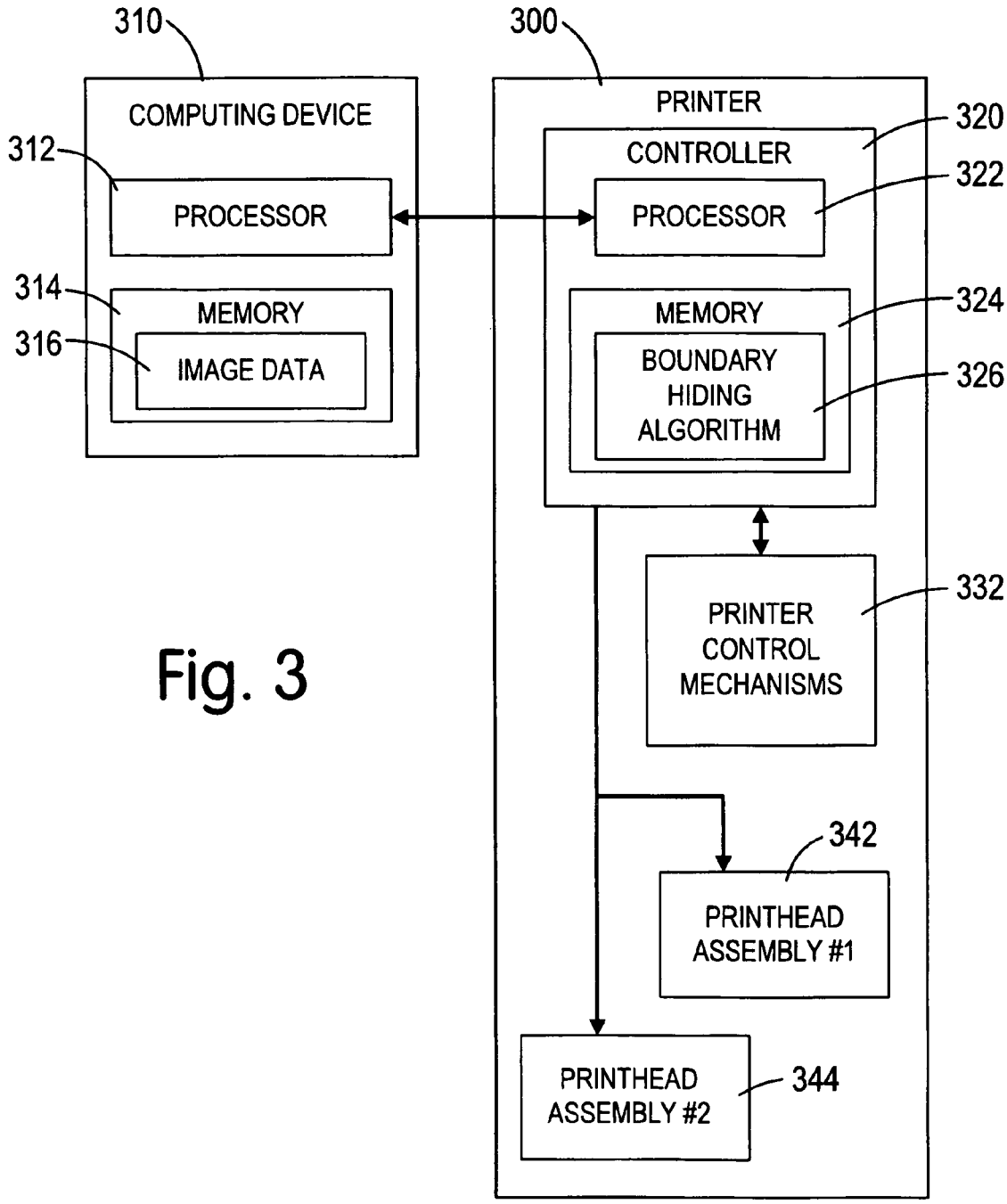
FIG. 3 is a schematic view of the exemplary inkjet printing system of FIGS. 1 and 2.

FIG. 3 is a schematic view of the exemplary inkjet printing system of FIGS. 1 and 2. Computing device 310 may be a computer directly connected to the printing system 300, or may be multiple computers accessing the printing system over a network, such as a Local Area Network (LAN). Computing device 310 typically includes a processor 312 having access to memory 314 including image data 316. The computing device 310 typically formats the image data in a form which may be utilized by printing system 300.

Printing system 300 typically includes a controller 320 which includes a processor 322 having access to memory 324. The memory may include the boundary hiding algorithm 326 of the present invention, together with other programs, parameters, and print data.

The controller 320 typically generates print data for each printhead assembly 342, 344 in the printer, and also controls other printer mechanism 332, such as, for example, controlling the drum rotation, paper feeding mechanism, and media dryers (not shown). Although two printhead assemblies are shown in FIG. 3, a different number of assemblies may be used, as discussed above. In generating print data for each of the printhead assemblies, the controller typically forms data addressing the individual print nozzles within each assembly, enabling those nozzles required to form the desired image.

Figure 4:
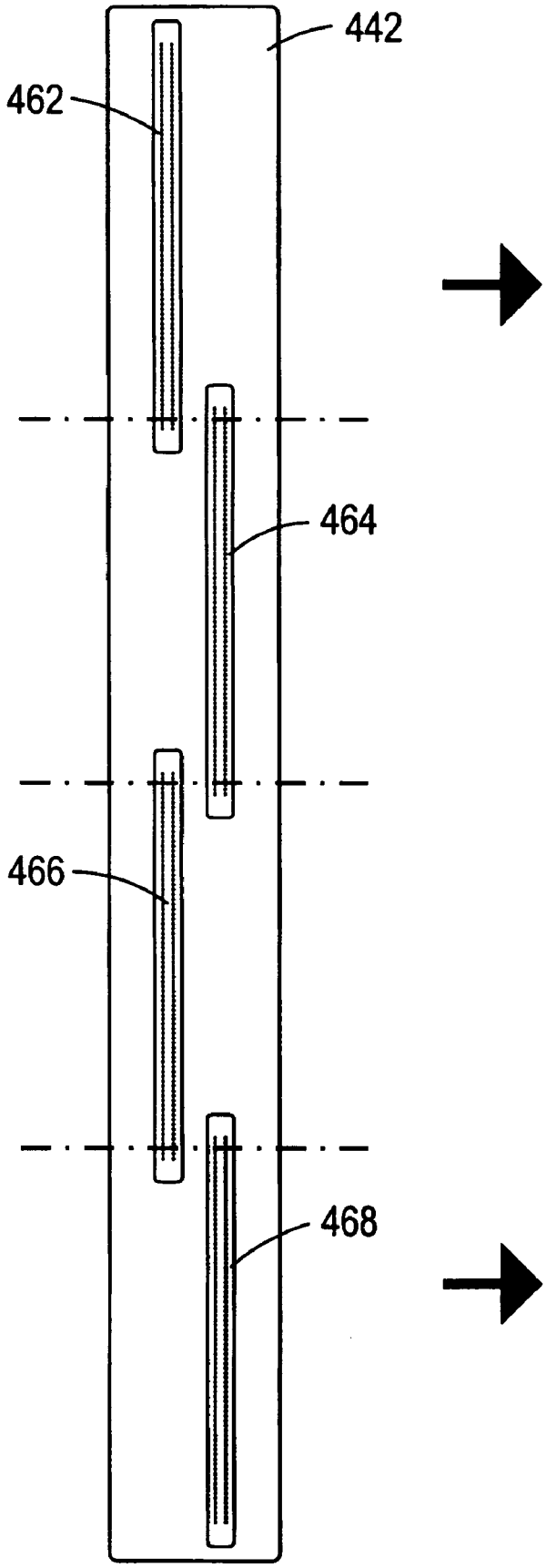
FIG. 4 illustrates in simplified form how multiple printhead die are arrayed within a printhead assembly.

FIG. 4 illustrates in simplified form how multiple printhead die 462, 464, 466, 468 are arrayed within a printhead assembly 442. Each of the printhead die 462, 464, 466, 468 is shown having two linear arrays of print nozzles, such as might be used to print two different ink colors. The individual die are arrange in a staggered pattern perpendicular to the direction of the media transport (indicated by the arrows). As indicated by the dashed lines, each printhead die overlaps the span of the adjacent dies by a small amount (i.e., there is a region near the ends of adjacent die where the rows of nozzles of the adjacent die overlap).

When printing with multiple printhead die per printhead assembly, a difficult challenge is hiding the "joint" where one die stops printing and the next die starts printing. Small misalignments between where the printhead dies are physically mounted, as well as aerodynamic effects during printing, makes hiding this joint extremely challenging.

A straight forward solution is to perform a diagnostic test that determines, for an ending nozzle on a given die, what the best starting nozzle to use on the adjacent dies should be in order for ink from to the two dies to align on the page without a gap or an overlap. This is often called a butt joint (a term borrowed from woodworking). While in theory this straight forward solution works, and diagnostics to perform this alignment exist, in practice aerodynamics during printing cause this solution to fail. In particular, when a die is printing at a high density, airflow will tend to pull the ink from the end nozzles back towards the center of the die, leaving a white gap on the page between two adjacent die. Realigning to compensate for this effect leaves a dark line on the page where the die overlap when printing at a low density and the ink is not pulled towards the center of the die.

A more complex solution is to "dither" the output of the end nozzles on two adjacent dies. That is, instead of stopping one die at a particular nozzle and starting the next die at another nozzle, all of the nozzles that overlap between the two dies are used. There are many ways this can done (e.g. use every other nozzle from each die, randomly choose which nozzle from which die gets used, etc) but the end effect is to spread the joint between dies out over a larger area. This solution can sometimes be effective, however, it is even more sensitive to die-to-die misalignment and is not free from the aerodynamic problems. In fact, when this solution fails, it usually produces a worse artifact than the first solution since the joint covers more physical page space and is therefore more visible.

One method that has been shown to be effective in hiding print defects of this nature is to perform multiple print passes while "indexing" the printhead assembly between passes. In indexing, the entire printhead assembly is moved slightly such that the joints between printhead die (or the location of other defects, such as faulty nozzles) fall in a different location during the subsequent printing pass. A disadvantage with physically indexing the printhead assembly is that the time required to physically move the assembly slows down the printing process.

Figure 5A:
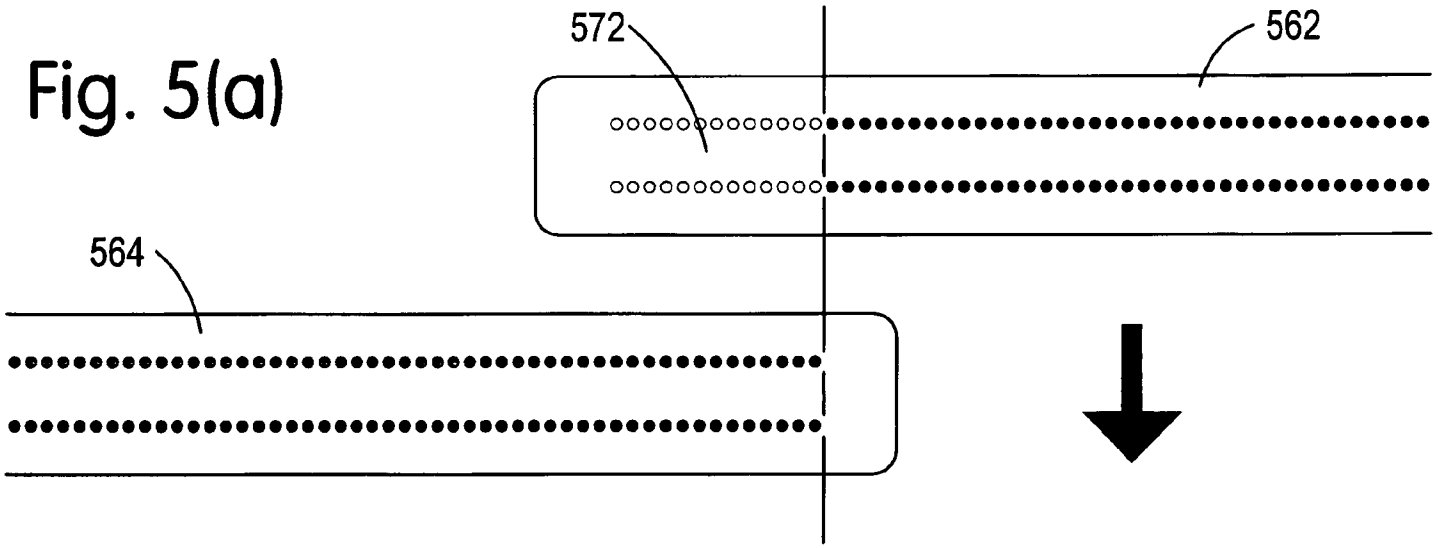
FIGS. 5(*a*) and 5(*b*) illustrate how different sets of nozzles may be disabled on separate printing passes such that the boundaries between printhead dies are substantially obscured, according to an embodiment of the invention.
Figure 5B:
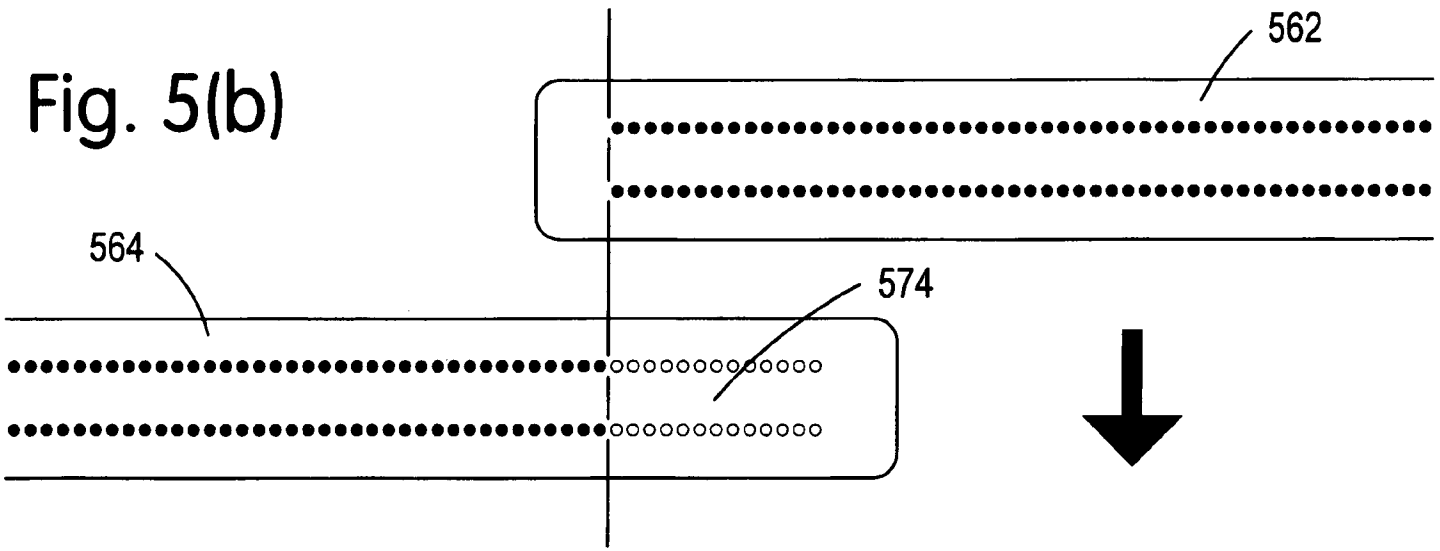

Embodiments of the present invention provide many of the advantages of indexing (the hiding of boundaries between printhead dies), without incurring the time and performance penalty of indexing. FIGS. 5(*a*) and 5(*b*) illustrate how different sets of nozzles may be disabled on separate printing passes such that the boundaries between printhead dies are substantially obscured. FIG. 5(*a*) illustrates how, during a first printing pass, a set of nozzles 572 of printhead die 562 is disabled (denoted by the open circles). In a subsequent printing pass (FIG. 59*b*)), all the nozzles on die 562 are enabled (denoted by solid circles), while a set of nozzles on adjacent die 564 are disable). Since the dies themselves are not "indexed" and span substantially the same area on each printing pass, the effect is to move the "butt joint" between the die between passes, and thus help obscure the joint. While illustrated for a single set of die 562, 564, the method may of course be applied to all of the boundaries between adjacent printhead dies, such as where the dies form adjacent pairs 462/464, 464/466, and 466/468 in FIG. 4.

The butt joints need not fall at the extreme ends of the dies, but may be positioned anywhere within the overlap. By way of further example, the two dies may be imagined to overlap by approximately 12 nozzles. On a first printing pass pass, the first die may stop printing at nozzle one of the overlap and the second die may start printing at nozzle two. On the next pass, the first die may stop printing at nozzle seven of the overlap and the second die may start printing at nozzle eight. In this way, the location of the joint is moved six nozzles between passes without having to physically move the pen.

An advantage of the present invention is that it allows the use of simple butt joints between dies. Butt joints are the preferred method of combining multiple die for many reasons, not the least of which is their simplicity and ease of implementation. Being able to use a butt joint between die gives developers fewer constraints during design.

The primary advantage, however, is that the present invention provides a way to hide the joint between dies without needing to reposition the entire printhead assembly between passes, which can result in a tremendous performance gain. For example, in a test printer, the throughput when indexing the printhead assemblies was approximately 50 pages per minute, while the throughput without indexing was approximately 70 pages per minute (a performance gain of about 40%).

Figure 6:
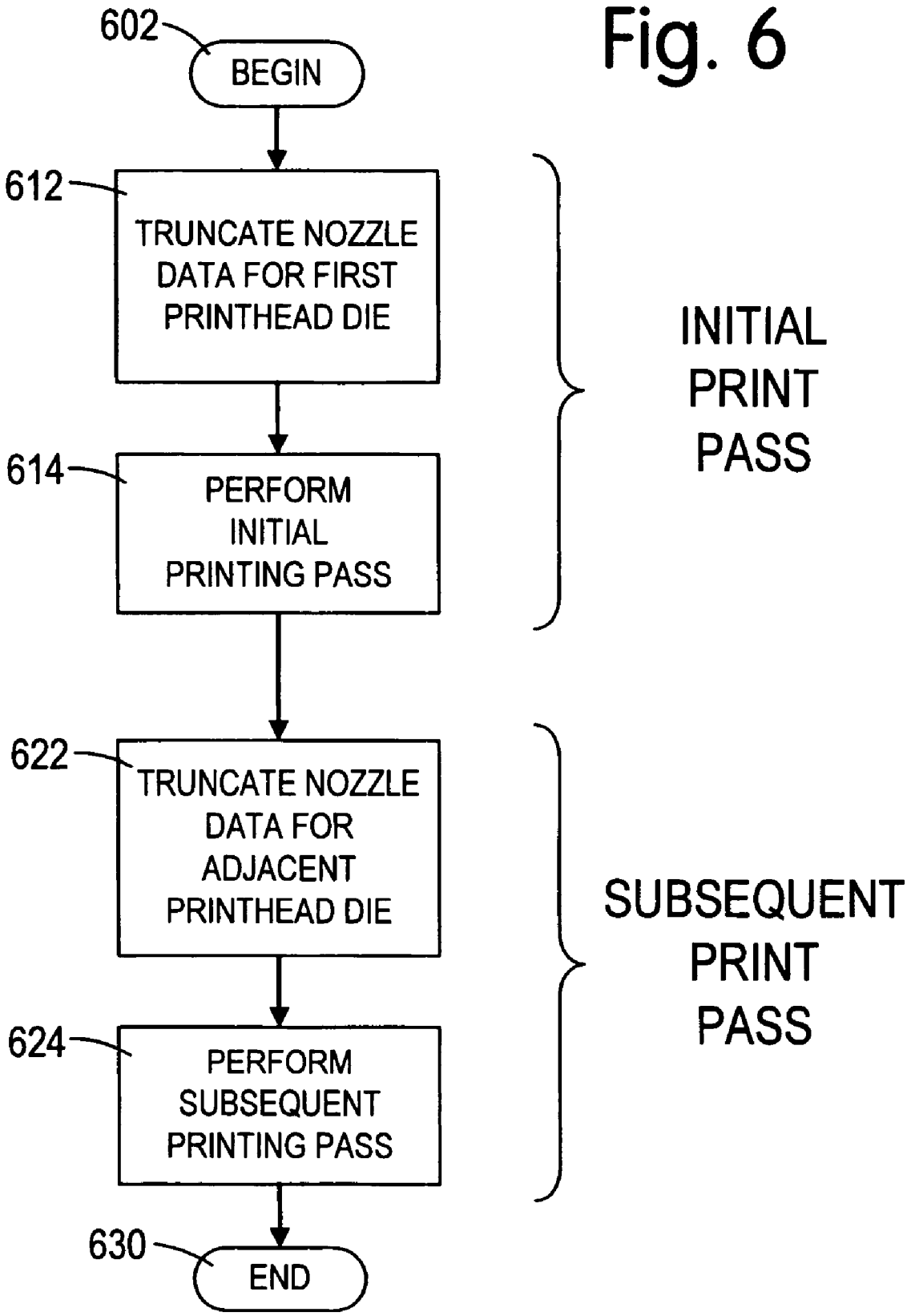
FIG. 6 is a flow chart further illustrating an embodiment of the present invention.

FIG. 6 is a flowchart summarizing the steps of an embodiment of the method of the present invention. The method begins 602 with an initial printing pass, in which the nozzle data for a first printhead die is truncated 612 and the initial print pass performed 614. "Truncation" when used with respect to the present invention means that a number of inkjet nozzles at the end of the printhead die are prevented from "firing" or depositing ink on the print media. On a subsequent printing pass, the nozzle data for an adjacent printhead die is truncated 622, the subsequent printing pass is performed 624, and the exemplary method ends 630. Thus, the "joint" between the two adjacent dies is effectively "moved" between the two print passes, as shown in FIGS. 5(*a*) and 5(*b*), helping to prevent visible print defects.

As discussed above, the nozzle data for both adjacent printhead dies may alternately both be truncated, with the amount of truncation data varying between two print passes, such that the "butt joint", while not fall at the end of either die, is effectively moved between print passes. When a printhead die is used to eject two or more colors of ink, the butt joints for each color may be placed at the same location, or may be in separate locations. Embodiments of the present invention may also be utilized to help conceal visible print defects between multiple printhead assemblies, such as indicated at 242 and 244 in FIG. 2. Further, embodiments of the present invention may be used in combination with other techniques to further conceal the joints between printhead dies and improve print quality.

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

The corresponding structures, materials, acts, and equivalents of all means or step plus function elements in the claims below are intended to include any structure, material, or acts for performing the functions in combination with other claimed elements as specifically claimed.

What is claimed is:

1. An inkjet printing system, comprising:

a media path;

at least one printhead assembly with multiple printhead dies, the printhead assembly configured to be held substantially stationary and perpendicular to the media path during a printing pass;

the multiple printhead dies each having at least one row of ink ejection nozzles, the multiple printhead dies mounted in the printhead assembly in a staggered pattern such that a span of at least one row of a first printhead die has a region of overlap with a span of at least one row of a second printhead die;

a controller, the controller operable to disable a group of nozzles on the first printhead die within the region of overlap during an initial printing pass, and to disable a group of nozzles on the second printhead die within the region of overlap during a subsequent printing pass; and a rotatable drum, wherein a printing pass is achieved by rotating the drum past the at least one printhead assembly.

2. The inkjet printing system of claim 1, wherein media is held to the rotatable drum by air suction.

3. The inkjet printing system of claim 1, wherein the multiple printhead dies further comprise at least three printhead dies, with overlap regions between each pair of adjacent die, and wherein the controller is operable to disable a group of nozzles on one printhead die within each overlap region during an initial printing pass, and to disable a group of nozzles on an adjacent printhead die within each overlap region during subsequent printing pass.

4. The inkjet printing system of claim 1, wherein the at least one printhead assembly with multiple printhead dies further comprises a first printhead assembly with multiple printhead dies and a second printhead assembly with multiple printhead dies.

5. The inkjet printing system of claim 4, wherein a printhead die on the first printhead assembly has a region of overlap with a printhead die on the second printhead assembly.

6. The inkjet printing system of claim 5, wherein the controller is further operable to disable a group of nozzles within the region of overlap on the printhead die on the first printhead assembly during an initial printing pass, and to disable a group of nozzles within the region of overlap on the printhead die on the second printhead assembly during a subsequent printing pass.

7. The inkjet printing system of claim 1, wherein the multiple printhead dies comprise a first printhead die and a second printhead die, the first printhead die and second printhead die each operable to eject more than one color of ink.

8. The inkjet printing system of claim 7, wherein the more than one color comprises a first color and a second color, at least one nozzle for the first color forming a first row and at least one nozzle for the second color forming a second row substantially parallel to the first row;

and wherein the group of nozzles at the end of the first printhead die nearest an adjacent die comprise a substantially the same number of nozzles for both the first row and the second row;

and the group of nozzles at the end of the adjacent printhead die nearest the first printhead die comprise a substantially the same number of nozzles for both the first row and the second row.

9. The inkjet printing system of claim 7, wherein the more than one color comprises a first color and a second color, at least one nozzle for the first color forming a first row and at least one nozzle for the second color forming a second row substantially parallel to the first row;

and wherein the group of nozzles at the end of the first printhead die nearest an adjacent die comprise a different number of nozzles for both the first row and the second row;

and the group of nozzles at the end of the adjacent printhead die nearest the first printhead die comprise a different number of nozzles for both the first row and the second row.

* * * * *

UNITED STATES PATENT AND TRADEMARK OFFICE

CERTIFICATE OF CORRECTION

PATENT NO. : 7,510,252 B2
APPLICATION NO. : 10/978079
DATED : March 31, 2009
INVENTOR(S) : Michael Vincent Conca et al.

It is certified that error appears in the above-identified patent and that said Letters Patent is hereby corrected as shown below:

Title Pg, Item (75), "Inventors", delete "Osbome" and insert -- Osborne --, therefor.

Signed and Sealed this

Fourteenth Day of July, 2009

JOHN DOLL
*Acting Director of the United States Patent and Trademark Office*